US006019330A

United States Patent [19]

Affrunti

[11] Patent Number: 6,019,330

[45] Date of Patent: Feb. 1, 2000

[54] ROOF GUARD DEVICE FOR LIFTING OBJECTS ON TO A ROOF

[76] Inventor: John Affrunti, 830 S. Cleburne, Bartlett, Ill. 60103

[21] Appl. No.: 08/974,866

[22] Filed: Nov. 20, 1997

[51] Int. Cl.[7] ..... E04G 3/08

[52] U.S. Cl. ..... 248/237; 182/45; 248/148

[58] Field of Search ..... 248/237, 536, 248/328, 48.1, 148, 229.13; 52/179, 180, 94, 96; 182/222, 223, 16, 150, 45

[56] References Cited

U.S. PATENT DOCUMENTS

| | | | |
|---|---|---|---|
| 2,681,195 | 6/1954 | Brad et al. | 248/536 |
| 3,254,418 | 6/1966 | Steckle | 248/237 |
| 5,474,271 | 12/1995 | Raymond | 248/148 |
| 5,845,452 | 12/1998 | Pantano | 248/237 |
| 5,862,880 | 1/1999 | Nelson et al. | 248/237 |

*Primary Examiner*—Ramon O. Ramirez
*Attorney, Agent, or Firm*—Cherskov & Flaynik

[57] ABSTRACT

A Roof Guard device 10 utilized when an individual lifts an object 96 on to a roof structure 14 from a lower level that includes a stepplate 12 removably received upon a horizontal perimeter portion of the roof structure 14; a guardplate 16 pivotally joined to the stepplate 12; the guardplate 16 being positioned adjacent to a selected portion of the roof structure 14 to prevent the object 96, being raised from the ground, from contacting the selected portion of the roof structure 14.

5 Claims, 21 Drawing Sheets

ROOF GUARD DEVICE FOR LIFTING OBJECTS ON TO A ROOF

BACKGROUND OF THE INVENTION

1. Field of the Invention

The present invention relates generally to devices used for lifting objects on to a roof structure and, more particularly, to devices for preventing objects lifted towards a roof by an individual from becoming entangled with an under or lower portion of the roof structure.

2. Background of the Prior Art

Professional persons involved in the heating, ventilating and airconditioning (HVAC) business, and also in the roofing industry as well as non-professionals for various reasons often need to lift equipment or materials to the roof of a building. Although heavy machinery, such as cranes with an attached cherry picker, hoists and booms can perform the task, the time and expense of transporting the machinery to the desired location makes it impracticable. Generally, personnel must use either a pick-up truck or a van to transport their equipment and materials. In other cases, it is not practical to use heavy machinery due to accessibility problems. As a result, easily lifting objects such as compressors, motors, shingles, boxes nails, tools, or other materials to a roof by carpenters, roofers, maintenance technicians, or other repairmen without damaging the exterior of a building, the lifted object or the lifters back has been a problem for decades.

Although prior art devices exist to lift objects to the roof of a building, an exhaustive method often used is to manually lift the objects along a ladder from the ground to the roof to prevent damage to the exterior of the building and to the lifted object. This is especially true when the repairman is using his own equipment.

Several devices have been introduced for raising objects along a building's exterior. For example, U.S. Pat. No. 3,860,092 provides an overhead support for hoisting a rope which can enable the user to lift objects along the exterior surface of a building. The device is designed primarily for emergency situations involving the fighting of fires. As such, the device has certain disadvantages when adapted to lift equipment or tools for repairs or servicing. First, the repairman's vehicle must have a winch attached to it for coupling with one end of the load line and a power supply to operate the winch. This can be impracticable using small vehicles. Second, the equipment or material lifted can slide against the building's exterior causing harm to the equipment, material, or exterior of the building while in use. Although this is acceptable in an emergency, it is unacceptable in a non-emergency. Furthermore, lifted objects can become stuck under the building's soffit, increasing the difficulty to raise the objects to the roof and causing further damage. Third, the object is generally raised a distance away from the roof of the building creating a dangerous situation whereby the repairman has to extend himself beyond the edge of the roof to retrieve the object. Additionally, the object when fully raised is below the level of the roof making retrieval of the object even more difficult and dangerous. Finally, the device requires existing building structures on the roof and ground to be free of defects.

Similar problems exist for U.S. Pat. No. 4,402,489 which discloses a protective hoisting guide over the edge of a roof. The hoisting guide is designed to protect the rope from breaking. Equipment, materials, and the building are not protected as objects slide along the building's exterior. Retrieval of the object is again below the surface of the roof at the end of the hoisting guide, and can be complicated due to the building's soffit.

Another device for raising or lowering materials is U.S. Pat. No. 5,341,898 having an overhead support for hoisting a rope. Again, this device was designed for emergency situations involving safety and rescue. The device is complex, costly and difficult to set-up. Further, the device raises an object away from the edge of the roof increasing the difficulty of retrieving it. Also, for larger objects, there is no protection for either the building's exterior or the lifted object. Finally, objects can engage and damage the soffit.

A need exists in the art for an inexpensive, quick set-up, portable device whereby an object can be readily lifted to the roof of a building without damaging either the object or the building, and providing safety and avoiding injury of the individual lifting the object. Additionally, the device should allow for easy retrieval of the object without extension beyond the edge of the building's roof. It is also highly desirable that such a device be easily removed from the roof and easily transported and that it be adaptable to various roof structures.

SUMMARY OF THE INVENTION

It is an object of the present invention to provide a device for an individual raising equipment and materials from ground level to the roof of a building to overcome many of the disadvantages of the prior art.

A principal object of the present invention is to provide a device to prevent an item lifted from ground level, from engaging an under or lower portion of a roof structure while lifting the item to the roof top. A feature of the device is that it is contoured to fit around the under portion of a roof. An advantage of the device is that the lifted item slides along the surfaces of the device and therefore prevents damage to the under or lower portion of the roof. Another advantage is the reduced force an individual must exert when lifting the item to the roof top.

Still a further object of the present invention is to enable easy removal of the device after all items are raised to the roof. A feature of the present invention is that the device easily mounts to a horizontal perimeter portion of the roof. An additional feature of the invention is that it has a pivotable planar surface. An advantage of the device is that it is adaptable to a myriad of roof designs. Another advantage is that it allows an individual to stand with one foot on the device thereby stabilizing the device.

Yet another object of the present invention is to enhance worker safety. A feature of the device is that it has a standing-side, non-slip surface along the topmost planar region which is parallel to the roof of the building allowing a person to safely stand with one foot on the device while lifting an object. Additionally, a building-side, non-skid, surface in communication with the building's roof prevents the device from sliding off the building. An advantage of the device, is that a person can stand very close to the roofs edge without slipping thereby allowing easier retrieval of objects raised to the roof.

Another object of the present invention is to provide a roof guard device having easy adaptability to gravel roof surfaces. A feature of the present device is that it can be adapted to receive a gravel stop, which typically defines the periphery of a gravel roof. An advantage of the device is that the received gravel stop prevents the device from moving while lifting an item from ground to roof top, or from sliding off the building while unattended.

Yet another object of the present invention is to provide a device with easy expandability. A feature of this invention is that in one alternative embodiment the device has a means for expanding longitudinally along a roofs perimeter. An advantage of the device is that it can be adapted to protect different sized areas of the under portion of the roofs perimeter.

Still another object of the present invention is to provide a device that protects the object being lifted and the adjacent wall. A feature of the device is an attachment secured to the item being lifted, the attachment having castors joined thereto. An advantage of the device is that the item being lifted does not make direct contact with an adjacent wall but rather, is allowed to roll upward upon the wall's surface.

Briefly, the invention provides a roof guard device lifting objects on to a roof comprising a first member removably received on a first portion of a roof structure; a second member secured to said first member via joinder means; said joinder means enabling said second member to be variably positioned proximally to said first member; said second member positioned proximally to a second portion of said roof structure; and means for preventing communication between said second portion of said roof structure and an object urged against said second member of said device.

BRIEF DESCRIPTION OF THE DRAWINGS

The foregoing invention and its advantages may be readily appreciated from the following detailed description of the preferred embodiment, when read in conjunction with the accompanying drawings in which.

DETAILED DESCRIPTION OF THE PREFERRED EMBODIMENT

Figure 1:
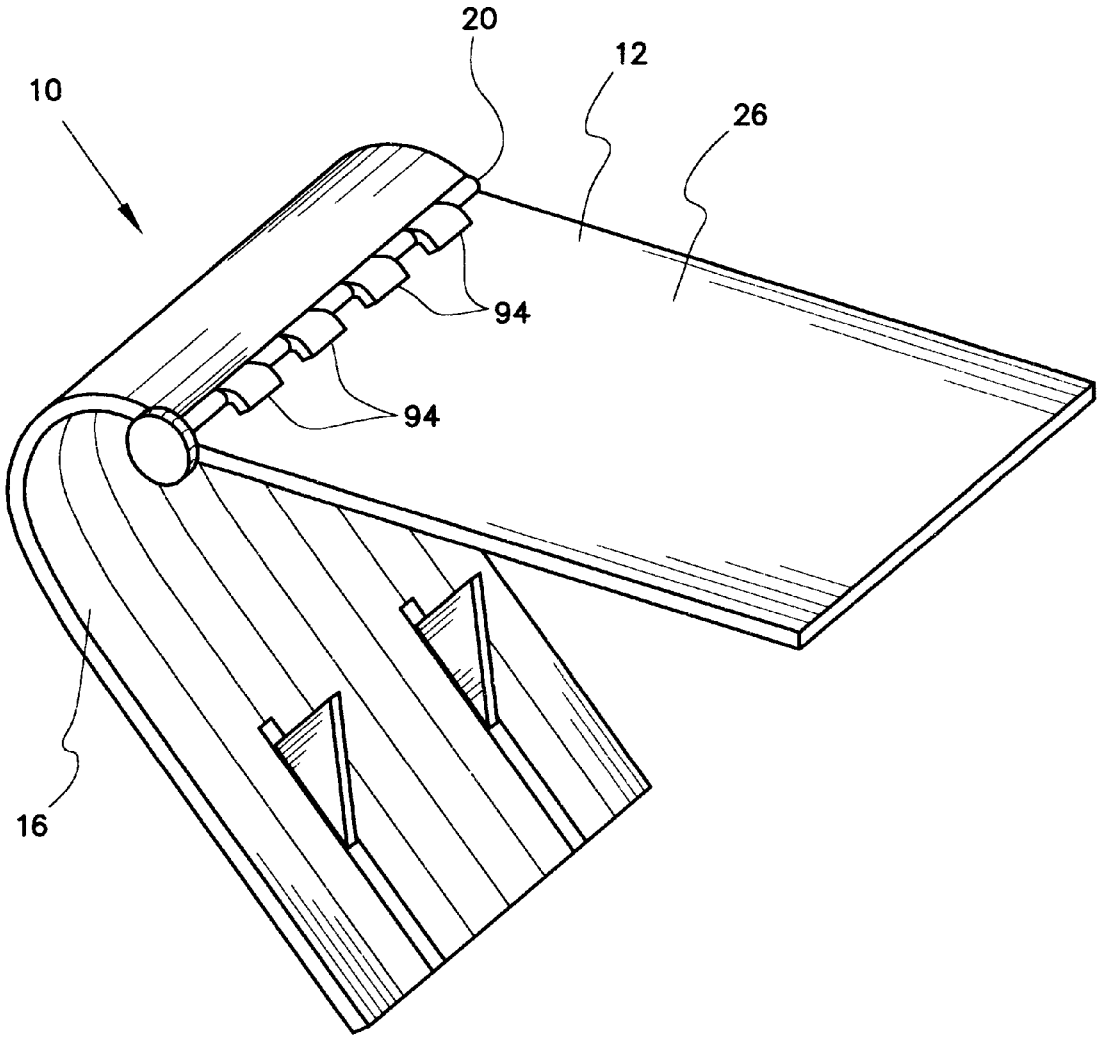
FIG. 1 is a front perspective view of a roof guard device in accordance with the present invention.
Figure 2:
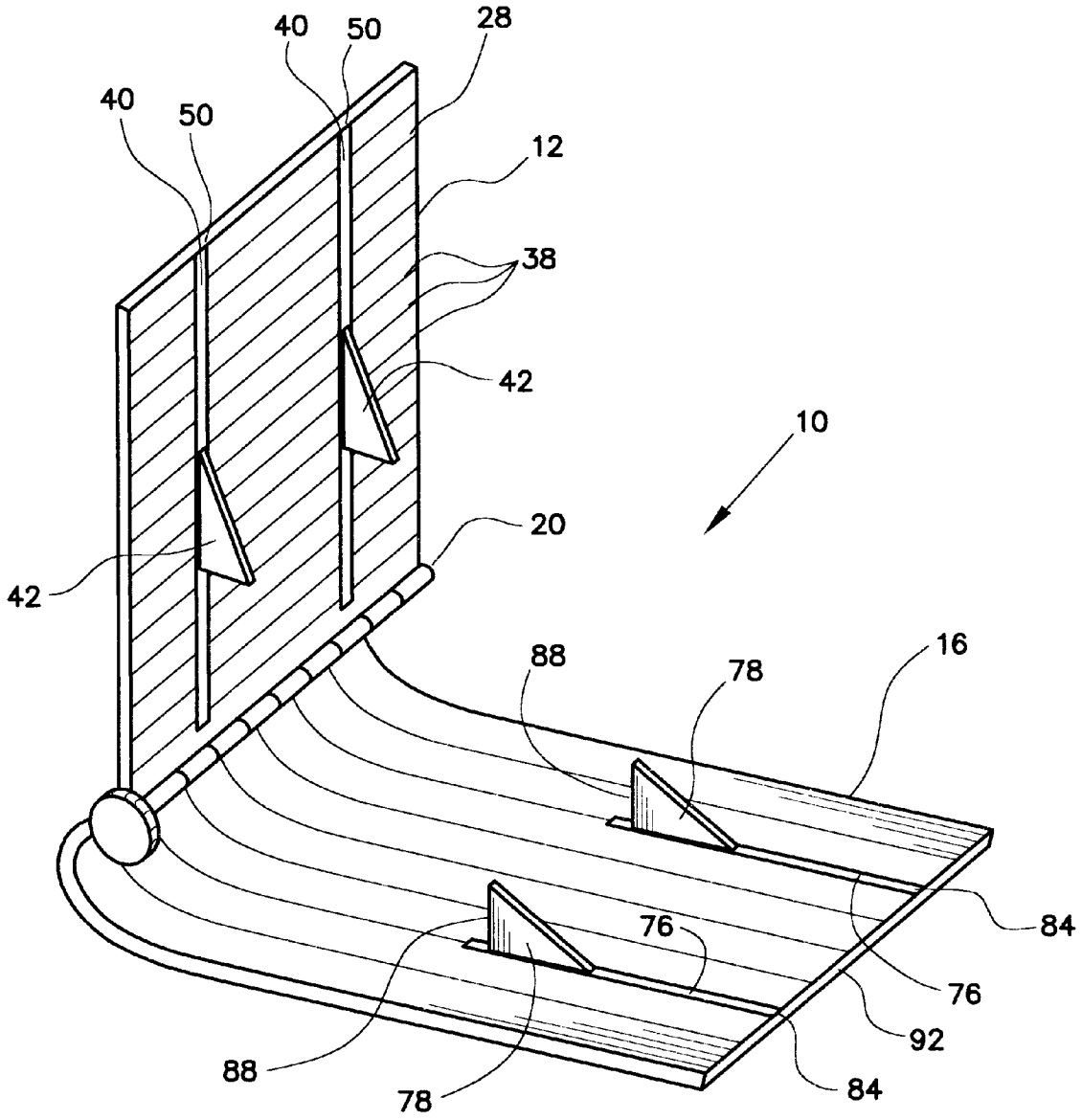
FIG. 2 is a front perspective view of a roof guard device with the stepplate positioned such that the underportion of the stepplate is exposed.
Figure 3:
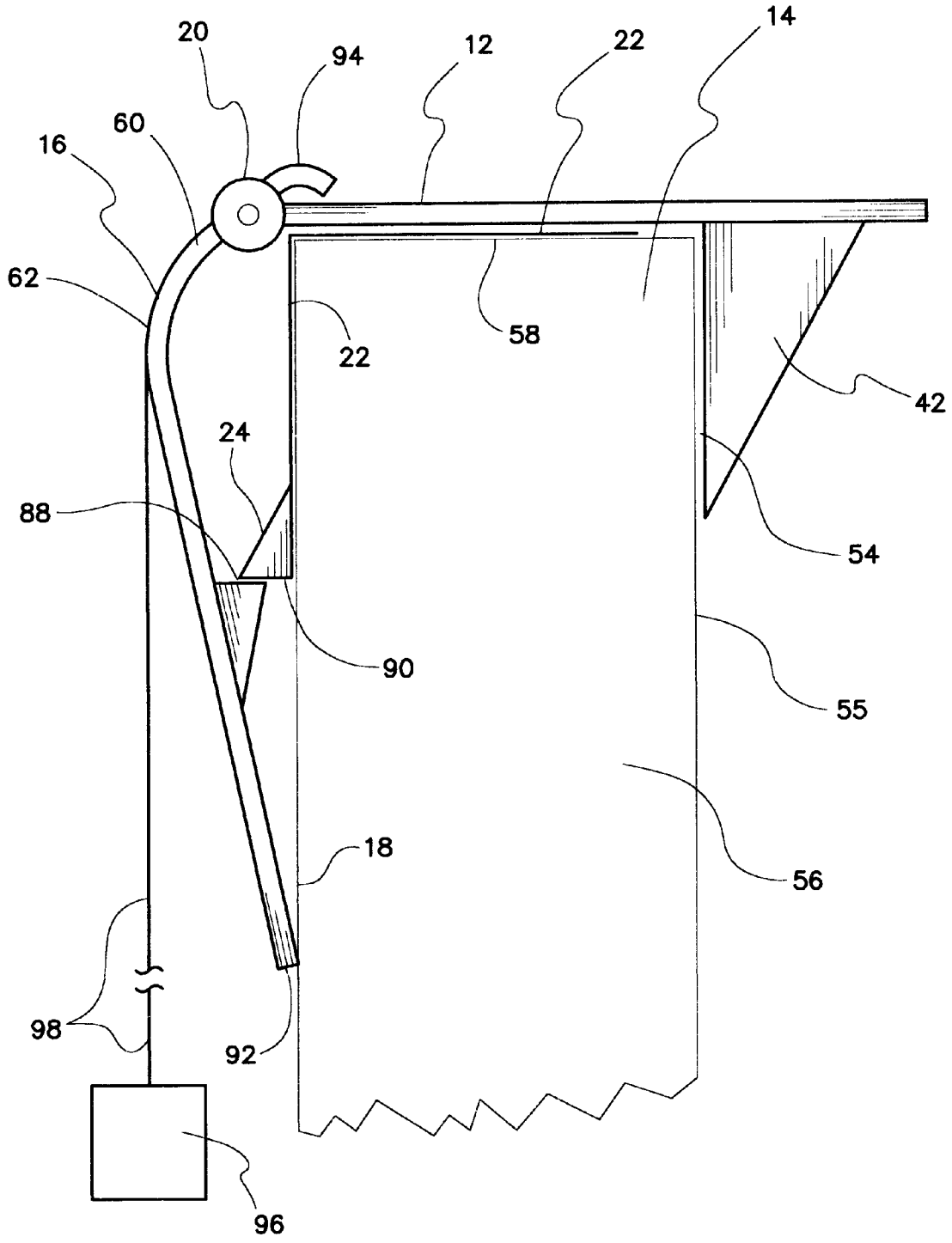
FIG. 3 is a side elevation view of a roof guard device placed upon a roof edge formed by a wall structure and a flat roof.

Referring now to the figures and in particular to FIGS. 1–3, a roof guard device in accordance with the invention is denoted by numeral 10. The roof guard 10 includes a first member or stepplate 12 that sets upon a roof structure 14, a second member or guardplate 16 that is proximally positioned adjacent to a wall structure 18, and a pivot or hinge joint 20 that adjustably joins the stepplate 12 to the guardplate 16. The gravel stop 22 prevents gravel from being swept over the edge of a roof and provides a wedge portion 24 that when interfaced with a portion of the guardplate 16, "locks-in" the position of the guardplate 16.

The stepplate 12 is fabricated from a rigid, unbreakable material such as steel, plastic or wood and has a substantially square configuration with a surface area sufficient for a person to place one foot upon. The distance between an upper surface 26 and a lower surface 28 is approximately one-half of an inch but may vary somewhat depending on the material of fabrication.

Figure 4:
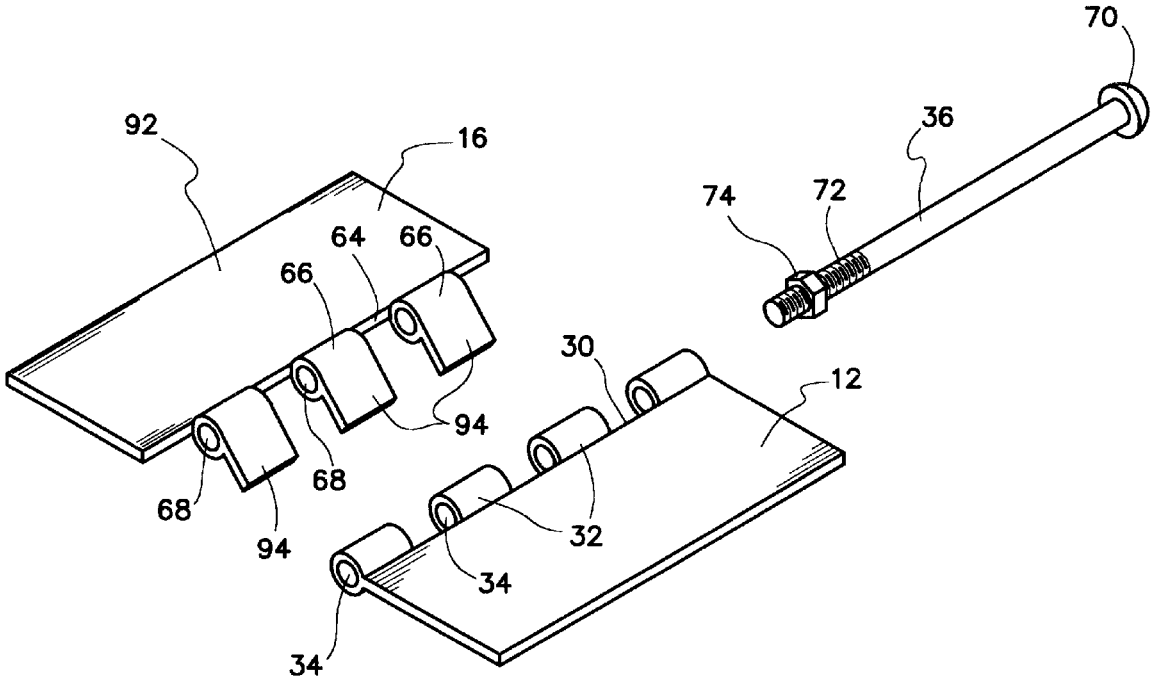
FIG. 4 is an exploded perspective view of the roof guard device showing the separated guardplate and stepplate and the means for securing the plates together.

Referring to FIG. 4, the stepplate 12 includes a first edge 30 having a series of segmented cylindrical hinge loops 32, each with a cavity 34 therethrough adapted to receive a hinge rod 36 therein to ultimately secure the stepplate 12 to the guardplate 16. The stepplate 12 has a series of ribs 38 integrally formed to the lower surface 28, equally spaced and positioned parallel with the first edge 30 and extending perpendicularly from the lower surface 28 not only provide extra rigidity and strength to the stepplate 12, but also to provide a means of securing the stepplate 12 to the roof structure 14.

The ribs 38 extend outwardly from the lower surface approximately one-eighth inch and are separated approximately one inch from each other and from the first edge 30. The ribs 38 could be joined to either the upper 26 or lower 28 surfaces of the stepplate 12, or could be joined to both surfaces. However, joining the ribs 38 to the lower surface 28 allows the ribs to act both as a strengthening means and a securing means. Obviously, placing the ribs 38 on top would then to act only as a strengthening means. Further, placing the ribs on top would tend to collect mud, dirt and other objects between the ribs 38 setting the stage for one losing their foothold.

Figure 5:
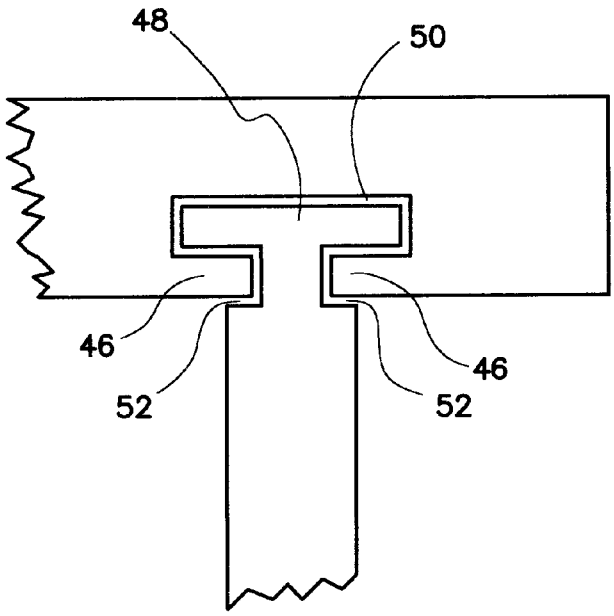
FIG. 5 is a cutaway side elevation view of a stepplate slidewedge inserted in a stepplate channel.

The lower surface 28 of the stepplate 12 includes a pair of spacially separated parallel channels 40 adapted to receive a first stepplate slidewedge 42 therein. The channels 40 are grooved into the lower surface 28 perpendicular to the ribs 38 and first edge 30, to a depth of approximately one-eighth inch. The channels 40 have a lateral dimension of approximately one inch and a configuration that includes a retaining lip 46 (See FIG. 5). Each channel 40 receives a base portion 48 of a plate slidewedge 42 therein that slides into the channel 40 via an entrance port 50. The plate slidewedge 42 has a lip channel 52 that is slightly larger than the retaining lip 46 of the channel 40 thereby allowing the wedge 42 to be slid into the channel 40 via the lip channel 52 while the retaining lip 46 secures the base portion 48 of the wedge 42 within the channel 40. The plate slidewedge 42 is dimensioned to be snugly received by the channel 40 so that there is resistance when trying to insert, remove or position the wedge 42 in the channel 40 thereby assuring that the position of the wedge 42 in the channel 40 will not vary unless a person exerts a sufficient force thereupon.

The plate slidewedge 42 includes a contact surface 54 (see FIG. 3) that is ultimately positioned against a sidewall 55 of a raised perimeter portion 56 of a roof structure 14. The raised perimeter portion 56 is encountered on tar and chip (gravel) roofs. The raised portion 56 is utilized to prevent the gravel, tar or both from being washed over the edge of a roof structure 14. Positioning the contact surface 54 of the wedge 42 against the sidewall 55 of the raised portion 56 when the wedge is inserted in the channel 40, "locks-in" the stepplate 12 position upon a top portion 58 of the raised perimeter portion 56. Obviously, if the roof is totally flat, one would not utilize the stepplate slidewedges, but rather would set the stepplate 12 directly upon the roof structure 14.

The guardplate 16 is fabricated from the same material as the stepplate 12 which includes but is not limited to steal, aluminum, plastic and wood. When taking a top or bottom view of the guardplate 16, a substantially square configuration is observed with a surface area substantially the same as that of the stepplate 12; however, when taking a side view of the guardplate 16 one observes a arcuately shaped profile. The guardplate 16 includes a dimension separating an inner surface 60 and an outer surface 62, that varies between one-quarter and one-half inch. The guardplate 16 further includes a first edge 64 (see FIG. 4) having a series of segmented cylindrical hinge loops 66, each with a cavity 68 therethrough adapted to receive the hinge rod 36 therein. The hinge loops 66 of the guardplate 16, and the hinge loops 32 of the stepplate 12 alternatively interlink and align to allow the hinge rod 36 to insert through all the cavities and form the hinge joint 20. The hinge rod 36 includes a retaining head 70 at one end, and a tapered threaded opposite end 72 that receives a retaining nut or "wing nut" 74 thereupon. The retaining head 70 limits the travel of the rod 36 through the loops 32 and 66 such that only a threaded end 72 extends from the last loop sufficiently to allow the nut to tighten down on the tapered threads until engaging the last loop thereby rigidly securing the respective positions of both the stepplate 12 and the guardplate 16.

The inner surface 60 of the guardplate 16 includes a pair of specially separated parallel channels 76 (see FIG. 2) adapted to receive a second or guardplate slidewedge 78 therein. The channels 76 are similarly grooved as the stepplate channels 40, into the inner surface 60 perpendicular to the first edge 64 to a depth of approximately one-eighth inch. The channels 76 have a lateral dimension of approximately one inch and a configuration that includes a retaining lip 80 (see FIG. 6). Each channel 76 receives a base portion 82 of a guardplate slidewedge 78 therein that slides into the channel 76 via an entrance port 84. The slidewedge 78 has a lip channel 86 that is slightly larger than the retaining lip 80 at the channel 76 thereby allowing the wedge 78 to be slid into the channel 76 via the lip channel 86 while the retaining lip 80 secures the base portion 82 of the wedge 78 within the channel 76. The guard slidewedge 78 is dimensioned to be snugly received by the channel 76 so that there is resistance when trying to insert, remove or position the wedge 78 into the channel 76 thereby assuring that the position of the wedge 78 in the channel 76 will not vary unless a person exerts a sufficient force thereupon.

The guardplate slidewedges 78 include contact surface 88 (see FIGS. 2&3) that are ultimately positioned against a bottom wall 90 of the wedge portion 24 of the gravel stop 22. The gravel stop 22 is utilized on flat, tar and chip (gravel) roofs to prevent the gravel, tar or both from being pushed over the edge of a roof structure 14 when one is standing, walking or working near the edge of the roof. Positioning the contact surface 88 of the slidewedges 78 against the bottom wall 90 of the wedge 24 when the slidewedges 78 are inserted in the channels 76, "locks-in" the guardplate 16 position such that a second edge 92 (truncated or pointed) of the guardplate 16 that is parallel to and opposite from the first edge 64 of the guardplate 16, is in communication with the wall structure 18. Obviously, if a peaked roof were encountered, one would not utilize the gravel stop 22 nor the guardplate slidewedges 78, but would instead maintain the position of the guardplate 16 against the wall structure 18 by tightening the wing nut 74 while the second edge 92 of the guardplate 16 is positioned adjacent to the wall structure 18.

The guardplate 16 further includes a motion limiter 94 extending beyond the perimeter of the first edge 64 and the hinge loops 66 of the guardplate 16. The limiter 94 is integrally formed to outer surface 62 of the guardplate 16 and extends in an arcuate configuration when taking a side view. The limiter 94 extends a distance that will ultimately cause the limiter 94 to engage the upper surface of the stepplate 12 when the guardplate 16 is pivoted about the hinge joint 20 a predetermined rotation thereby preventing further rotation of the guardplate 16 should an object 96 being lifted by a tensile element such as a rope 98 or cable, contact the guardplate 16 and force it to rotate.

In operation a roof flashing guard device 10 is placed at the edge portion of a roof structure 14 such that the stepplate 12 rests upon an edge portion of the roof structure 14. An arcuately shaped guardplate 16 is rotated into a position via the hinge joint 20 such that the guardplate 16 surrounds an item to be protected that is attached to the wall 18 or an underside portion of the roof structure 14. The item could include a rain gutter, roof flashing or roof soffit.

Once positioned, the roof flashing guard device 10 allows an individual to stand on the stepplate 12 and lift an object 96 from ground level via a rope 98. The rope may or may not engage the roof guard 10, but once the object 96 is near the roof structure 14, rather than the object 96 "bumping up" against a gutter or other item connected to the wall 18 or the underside of a roof, the guard device 190 via physical engagement with the object 96, directs the object 96 around the protected structure while the individual pulls upon the rope 98 thereby preventing communication between the roof structure 14 and the object 96.

Figure 7:
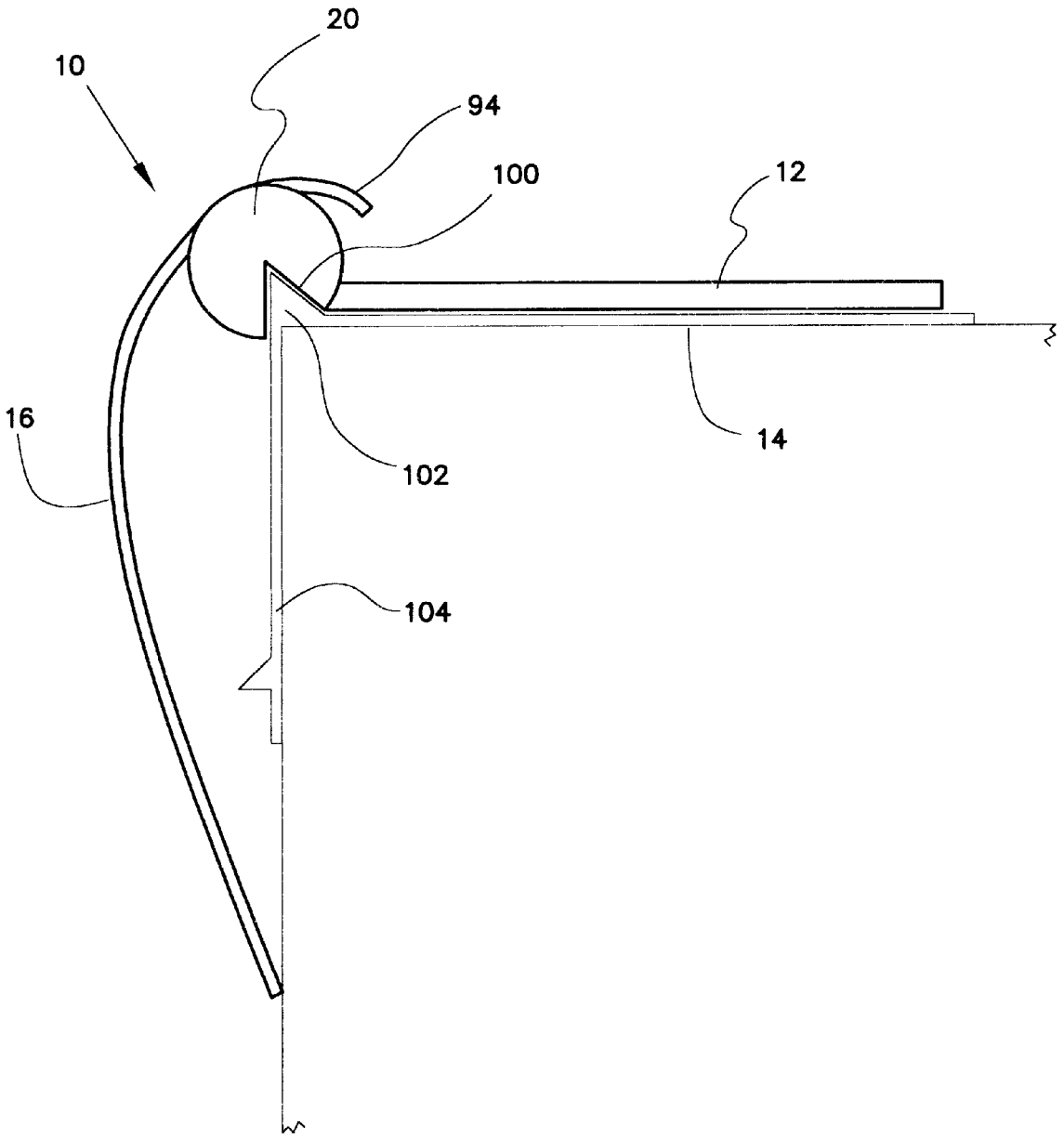
FIG. 7 is a side elevation view of a roof edge formed by a wall structure and a flat roof with a roof flashing attached thereto.

Referring now to FIG. 7, an alternative embodiment of a roof guard device 10 is shown in accordance with the present invention. The hinge joint 20 has been modified to include a channel or notch 100 to receive a ridge portion 102 of a roof flashing 104 utilized to prevent gravel from washing off the roof structure 14. The ridge portion 102 inserted into the hinge notch 100 not only avoids the deforming of the ridge 102, but also adds stability to the guard device 10 when an individual stands on the step plate 12.

Figure 8:
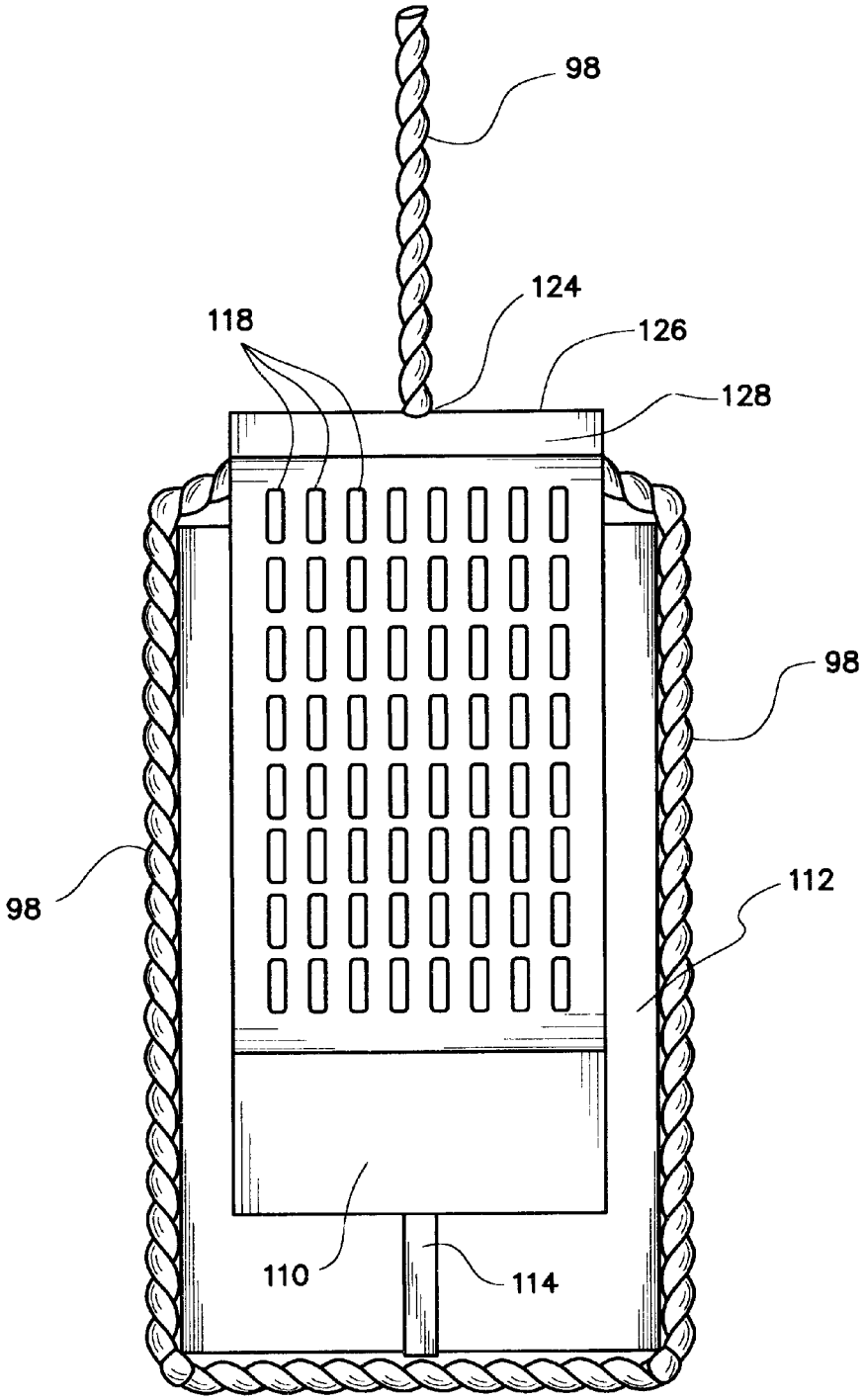
FIG. 8 is a front elevation view of an alternative embodiment of a roof guard device attached to a box in accordance with the present invention.
Figure 9:
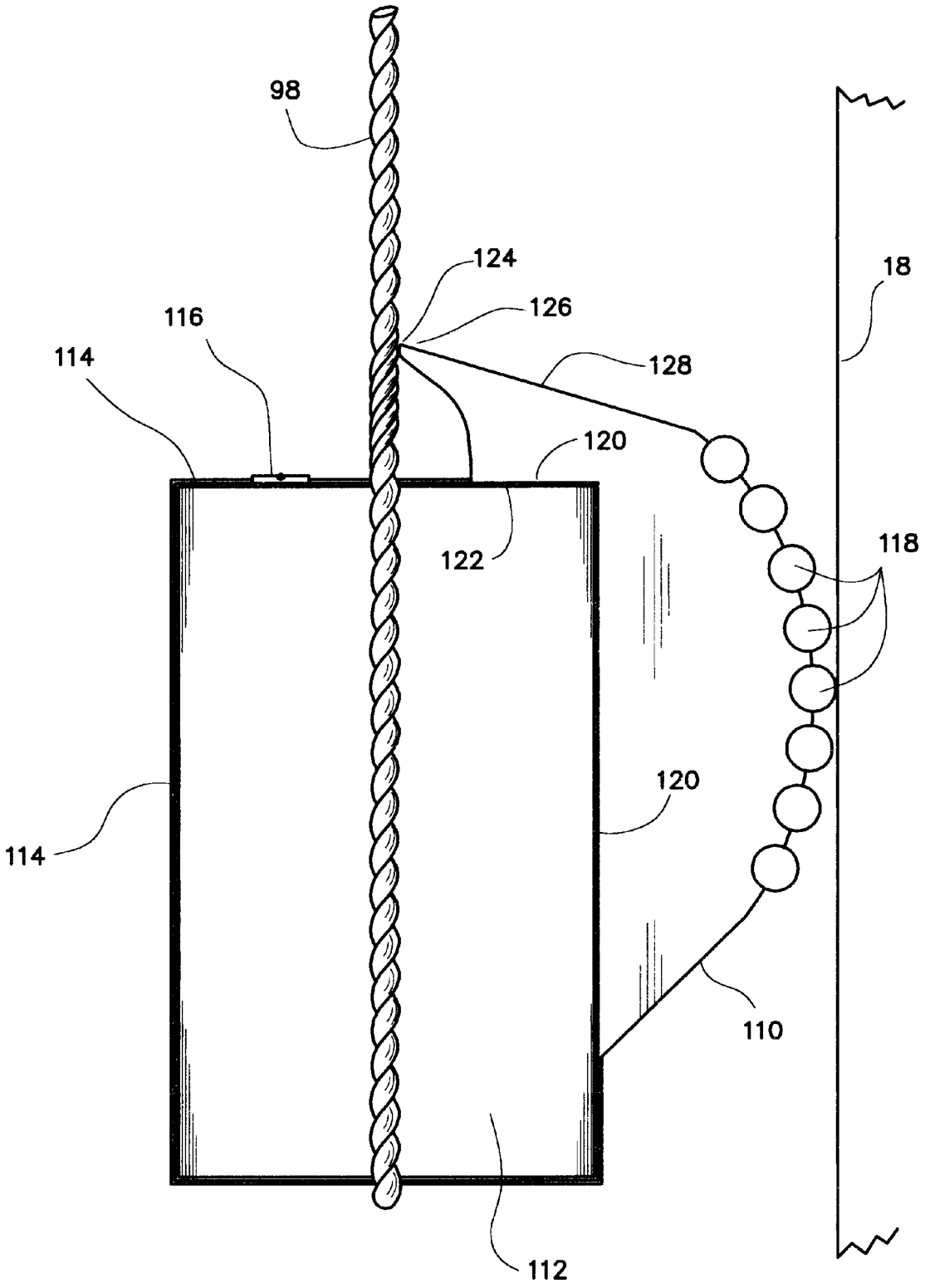
FIG. 9 is a side elevation view of the alternative embodiment of the roof guard device of FIG. 8.

Referring now to FIGS. 8 and 9, another alternative embodiment of a roof guard device 10 is shown in accordance with the present invention. A box guide 110 is attached to a box 112 that has dimensions that cause the box 112 to contact the wall structure 18 when the box 112 is raised to the roof structure 14. The box guide 110 is attached at a mid portion of the box 112 via a strap 114 that includes a securing buckle 116. The strap 114 is fabricated from nylon although alternative materials having similar strength may be utilized. The buckle 116 is fabricated from metal, alternatively, a metal having similar characteristics and resistant to corrosion could be used.

The box guide 110 is fabricated from lightweight, rugged plastic or metal and is arcuately shaped and includes a series of equally spaced swiveling rollers or castors 118 positioned about a substantial portion of the arcuately shaped perimeter of the box guide 110. The box guide has a box receiving portion 120 that is essentially a notch configured into substantially a right angle when taking a side view of the box guide 110. The receiving portion 120 allows the box guide 110 to set upon a top edge portion 122 of the box 112 where the guide is held in place by the strap and securing buckle 114 and 116. The guide 110 includes a rope notch 124 situated at a midportion of a top edge 126 of an extension ridge 128 that is a continuation of the arcuate perimeter of the guide 110. The rope notch receives the rope 98 secured to the box 112. Because the rope is held by an individual on the roof structure 14 lifting the box 112 upward, an acute angle is formed between the rope 98 an the top edge portion 122 of the box 112. After installing the box guide 110 and placing the rope 98 in the rope notch 124, an obtuse angle is formed between the rope 98 and the top edge portion 122, and an acute angle is formed between the rope 98 and a tangential horizontal line to the top edge 126. The configuration of the rope when taking a side view of the box guide 110 results in a horizontal force being exerted by the rope 98 into the rope notch 124 thereby preventing the rope from sliding out of the notch 124 and further securing and stabilizing the box guide 110 upon the box 112.

Figure 10:
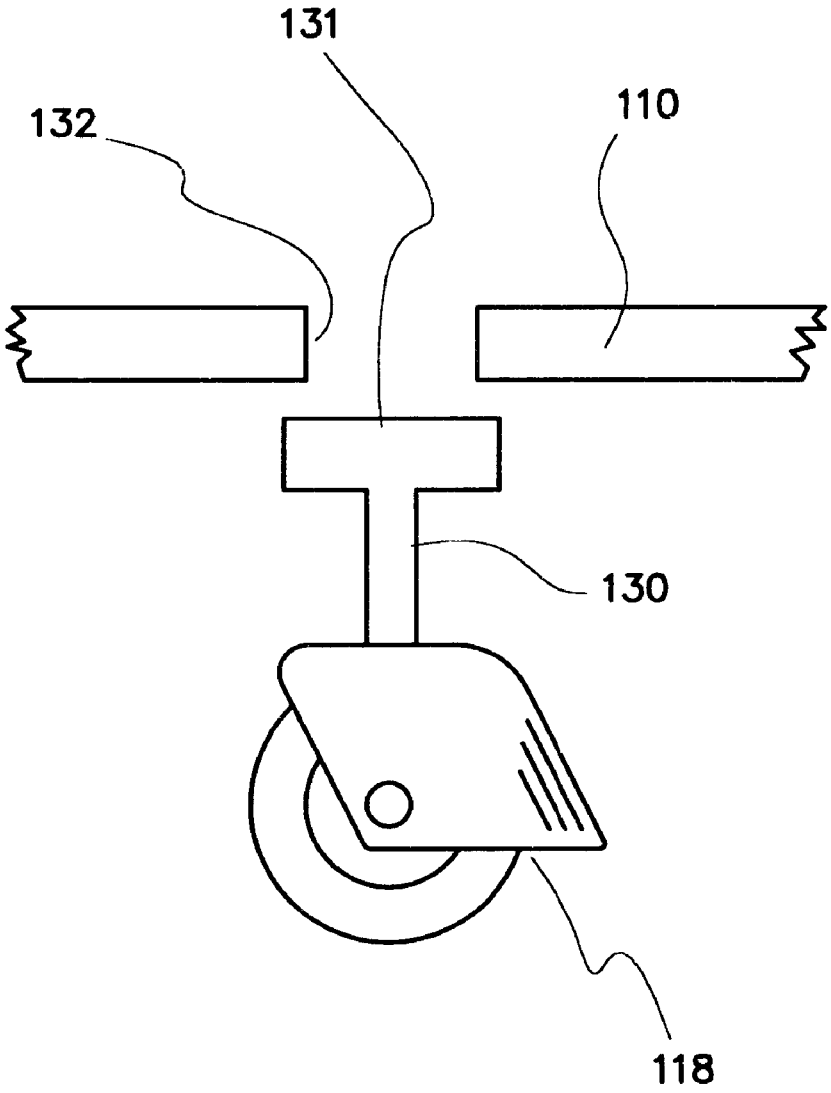
FIG. 10 is a side elevation view of the castors depicted in FIGS. 8 and 9.

Referring to FIG. 10, a side elevation view of a castor 118 is shown in accordance with the invention. The castor is a common item of manufacture well known to one of ordinary skill in the art. An exemplary type being the Institutional model manufactured by Faultless Caster in Evansville, Ind. The castor 118 includes a stem 130 having a longitudinal axis perpendicular to the wheel axis of the castor 118. The stem 130 has an expansion socket 131 secured thereto that inserts into a corresponding orifice 132 in the arcuate surface of the box guide 110. The orifice 132 is sized to forcibly receive the expansion socket 131 of the caster 118 which prevents the castor 118 from falling out of the orifice 132. The castors 118 are arranged in rows and columns in numbers great enough to insure that only the castors 118 will contact the wall or structure 18 or the roof guard 10 when the box 112 is lifted by the rope 98 to the top of the roof structure 14.

In operation, the box guide 110 is secured to the box 112. The box guide 110 and box 112 is placed adjacent to the wall structure 18 such that the castors 118 are in communication with the wall structure 18. The rope 98 is inserted in the rope notch 124, and an individual on top of the roof structure 14 begins to lift the box and guide assembly 112 and 110. The horizontal force of the rope 98 in the rope notch 124 is transmitted to the guide 110 thereby forcing the guide 110 and corresponding castors 118 against the wall structure 18.

Figure 11:
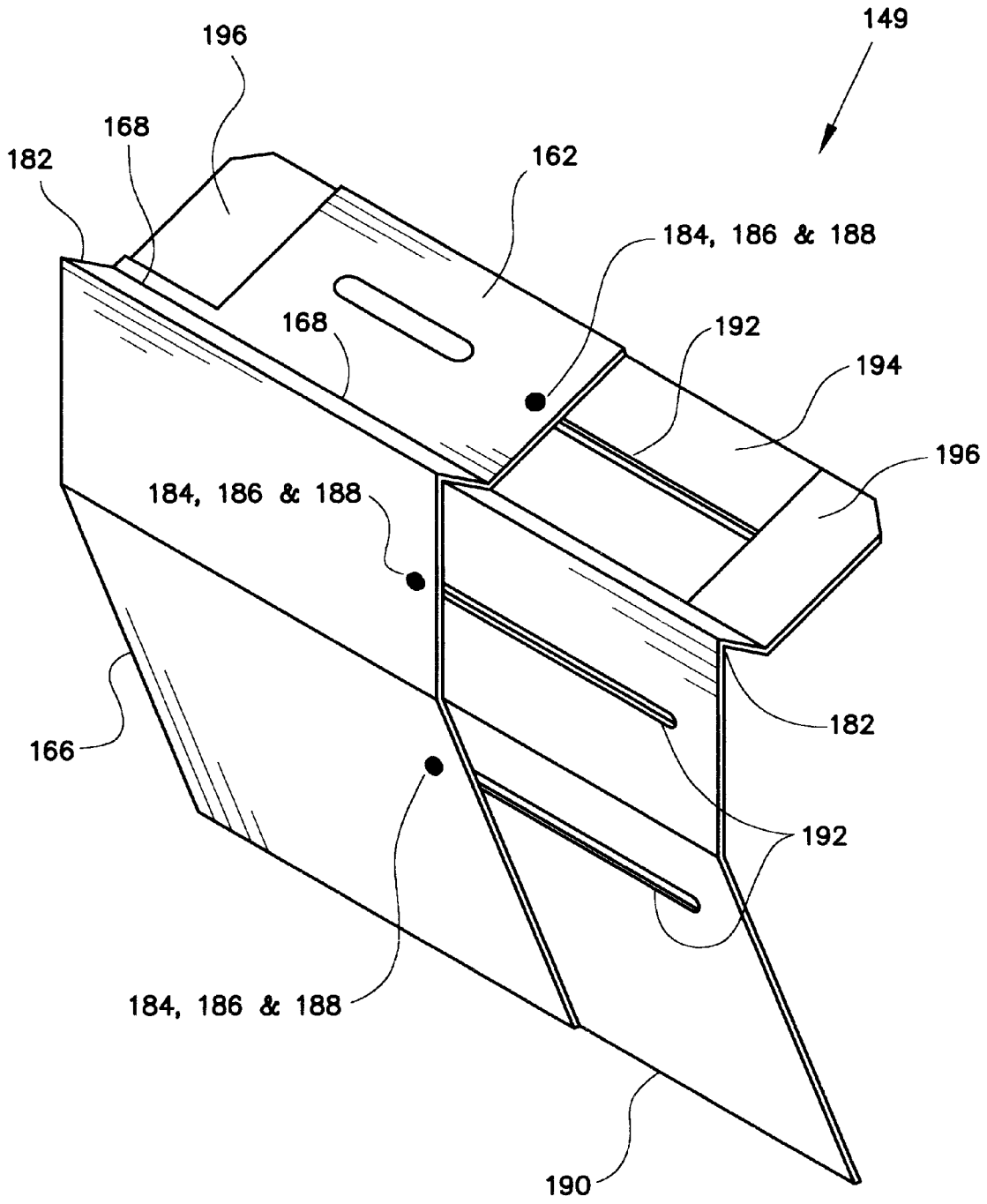
FIG. 11 is a perspective view of yet another alternative embodiment of a roof guard device in accordance with the present invention.
Figure 12:
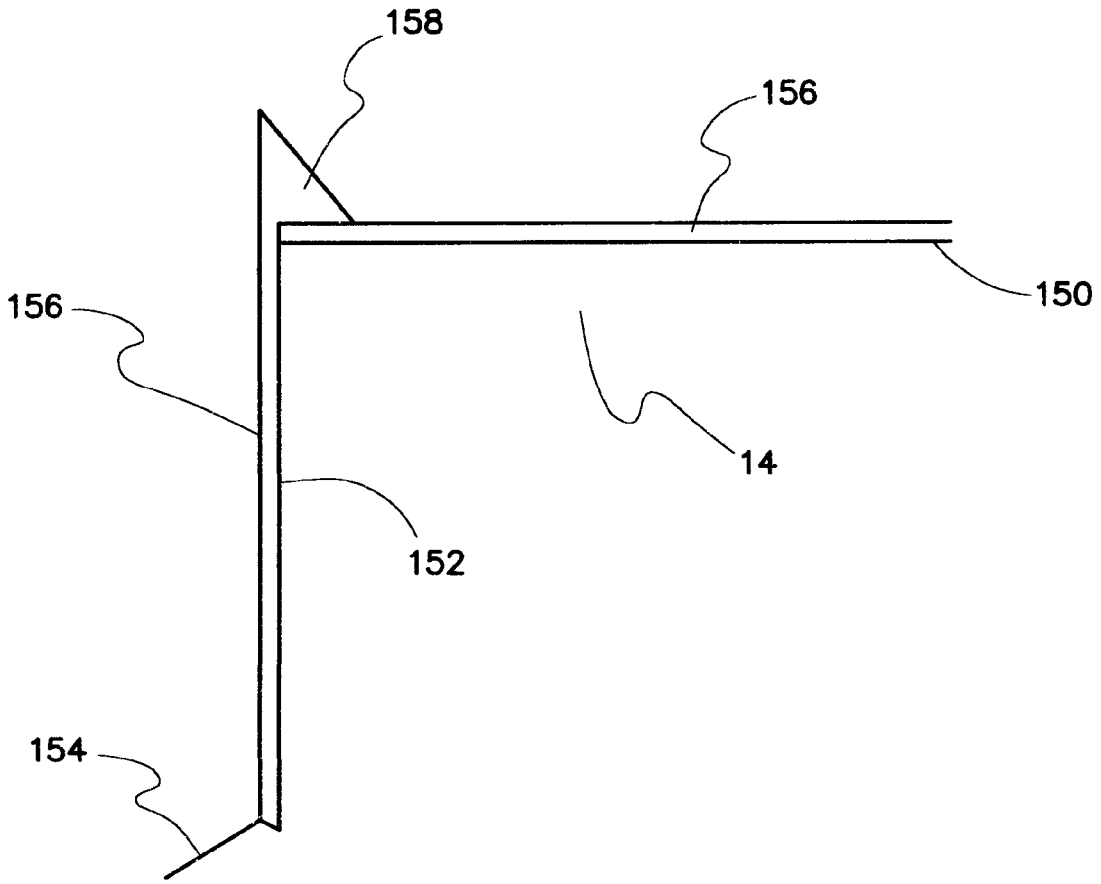
FIG. 12 is a side elevation view of a flat roof design that receives the roof guard device of FIG. 11.
Figure 13:
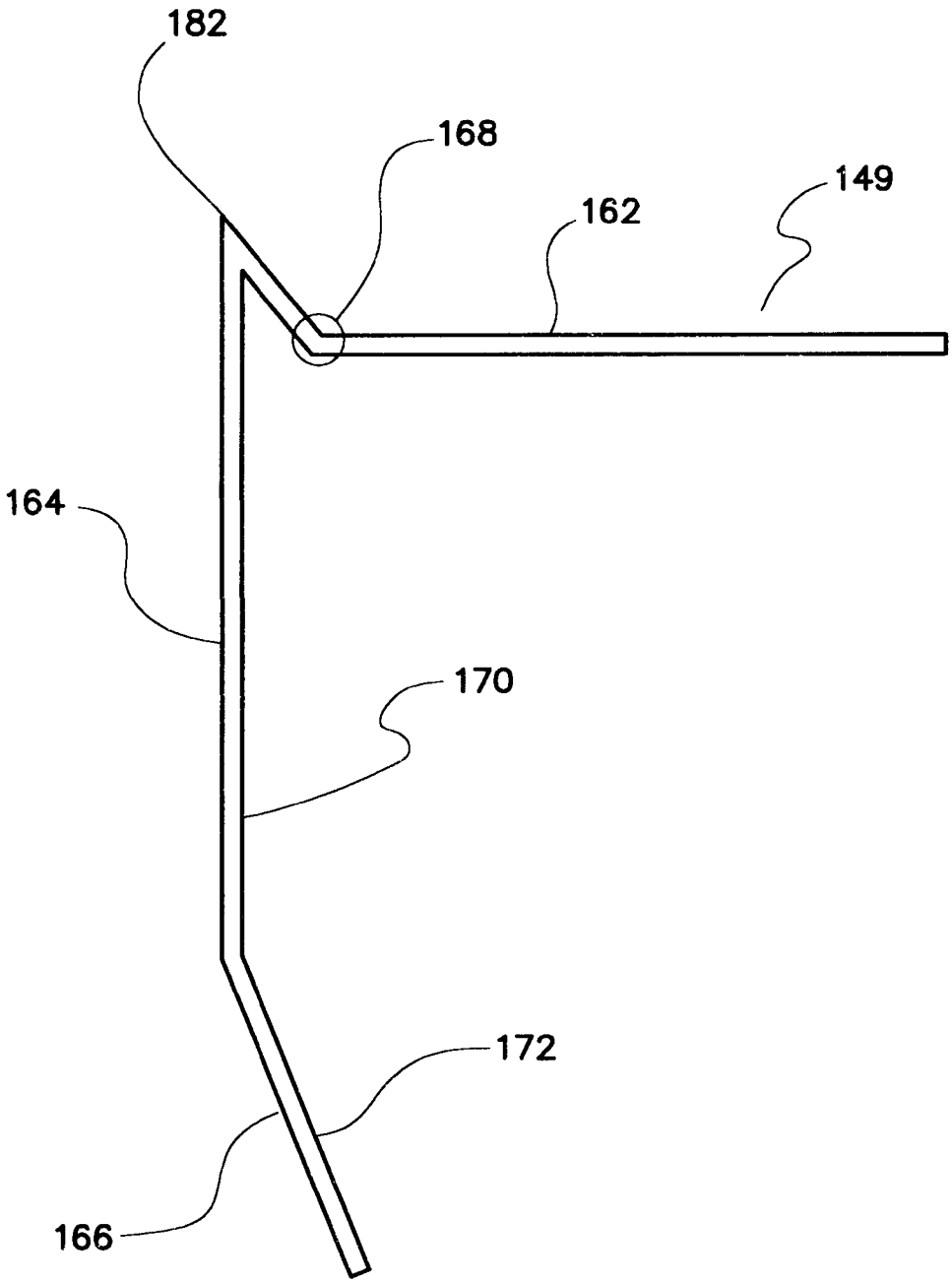
FIG. 13 is a side elevation view of the roof guard device of FIG. 11 in accordance with the present invention.

Referring to FIGS. 11 & 13, perspective and side elevation views of yet another alternative embodiment of a roof guard device 149 is shown in accordance with the present invention. FIG. 12 is a side elevation view of a particular roof design that receives the roof guard device 149. The roof design includes a top flat portion 150, a vertical side portion 152 and an outward angular portion 154. A flashing 156 having a retaining ridge 158 covers parts of the top and side portions 150 and 152. The retaining ridge 158 prevents gravel from washing over the edge of a flat roof 150.

Referring to FIG. 11 & 13, the roof guard device 149 includes a topplate 162, a sideplate 164 and angleplate 166. The top and sideplates 162 and 164 are joined via a hinge assembly 168 that allows the top and sideplates to rotate freely and be positioned upon a roof structure 14 whereby the topplate 162 sets upon the top portion 150 of the roof and the sideplate 164 contacts the side portion 152 of the roof. The sideplate 164 is integrally joined to the angleplate 166 such that a permanent obtuse angle is formed between inner wall 170 of the sideplate 166, and inner wall 172 of the angleplate 166.

Figure 14:
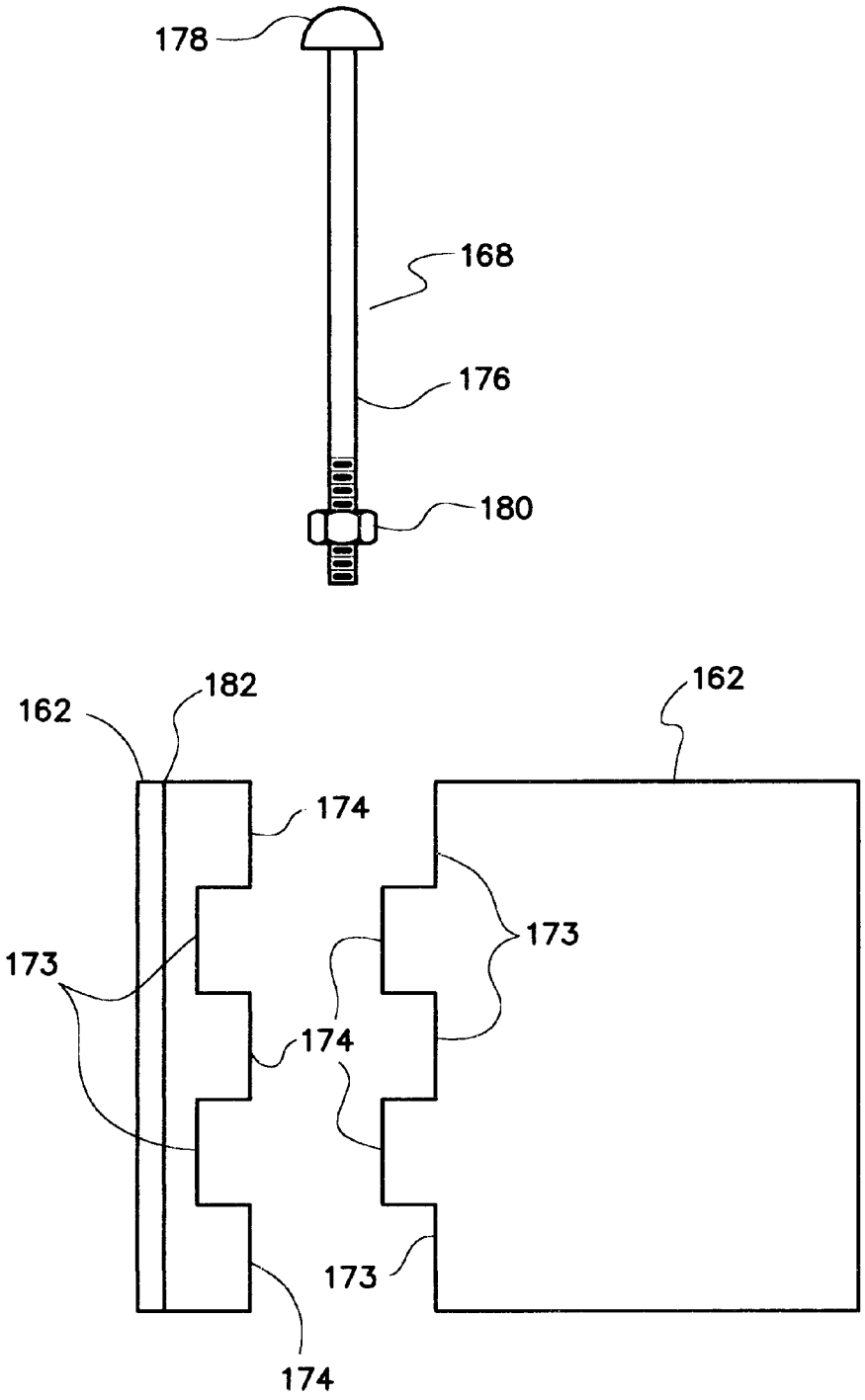
FIG. 14 is an exploded perspective view of the roof guard device of FIG. 11 showing the means for joining the plates together.

Referring to FIGS. 13 and 14, the hinge assembly 168 is formed from multiple cylindrical channels 174 equally spaced and positioned along an inner edge 173 of both the top and side plates 162 and 164. The channels 174 are sized and situated along the inner edges 173 to allow the channels to alternatively interjoin with an opposing channel from either the top or side plate. Once the channels are aligned, a connecting rod 176 is inserted through all the channels. The rod 176 has a retaining head 178 on one end and a tapered opposing end, threaded to receive a wing nut 180 thus allowing the top and side plates 162 and 164 to be variably positioned, then secured.

The sideplate 164 includes a gravel stop 182 that receives the retaining ridge 158 of the roof flashing 156 thereby securing the guard device 149 to the roof structure 14. Each plate 162,164 and 166 has an orifice 184 therethrough to receive a locking bolt 186 with a threaded end to receive locking nut 188 thereon. An extension portion 190 having the same configuration as the top, side and angle plates when taking a side view, is sized to snugly fit under the plates when the plates contact corresponding portions of the roof structure 14. The purpose of the extension plate is to allow the guard device 149 to have a larger contact area with the roof structure 14 and provide more surface for an individual to stand upon and more protective area for the immediate under portion of the roof structure 14 that will ultimately make contact with the object being lifted by the individual.

The extension portion 190 may expand to a myriad of positions via three longitudinal locking bolt receiving channels 192 that extend substantially the length of the extension portion 190 and have a lateral dimension equal to the orifice 184 diameter. The extension portion 190 is positioned adjacent and under the top, side and angle plates to correspond to a predetermined surface area to be protected by the guard device 10. The three locking bolts 186 are inserted through the three orifices and the three aligned channels 182 whereupon a locking nut 188 is tightly screwed on to the bolt 186 thereby securing the extension portion 190 to the respective top, side and angle plates 162, 164 and 166.

The top plate 162 and top section 194 of the extension portion 190 include non-skid surfaces 196 to aid with the safety of individuals standing on the guard device 149. The non-skid surfaces are comprised of stick-on type abrasive elements well known in the field.

Figures 15, 15A:
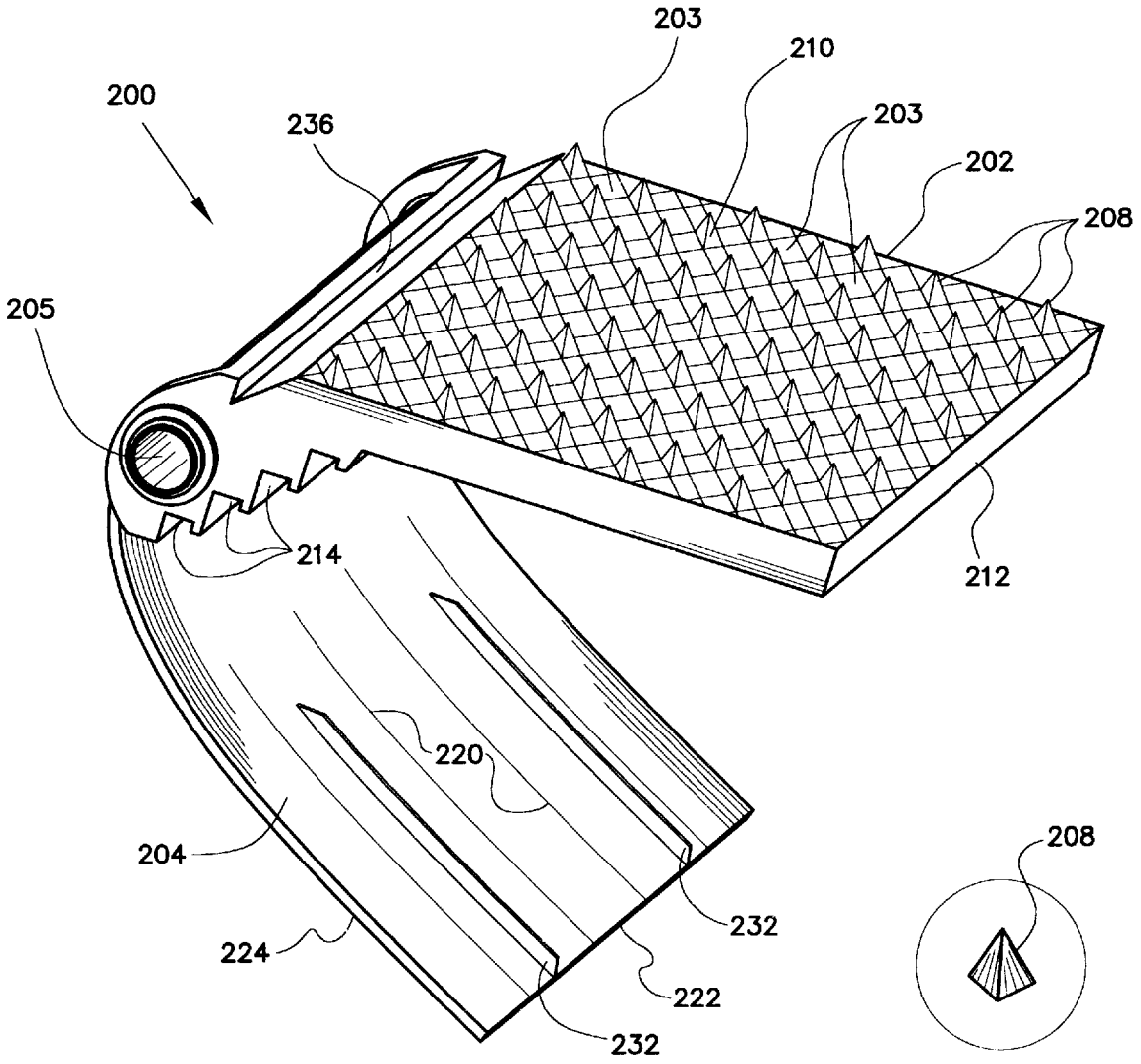
FIG. 15 is a perspective view of still another alternative embodiment of a roof guard device in accordance with the present invention.
FIG. 15A is a perspective view of a pyramid shaped spike forming part of the stepplate portion of the roof guard device of FIG. 15.

Referring to FIG. 15, a perspective view of still another alternative embodiment of a roof guard device 200 is shown in accordance with the present invention. The device 200 includes a stepplate 202 and guardplate 204. A hinge joint assembly 206 has the components illustrated in FIG. 4 that allow the guardplate 204 to be locked in a predetermined position. The stepplate 202 has a grating configuration with an open lattice design having multiple openings 203 therethrough to receive gravel or other roof materials to secure the stepplate 202 to a roof The stepplate 202 includes multiple pyramid shaped spikes 208 on upper and lower surfaces 210 and 212 utilized for digging into the tar portion of a roof and for better traction for a person standing on the stepplate 202. The stepplate 202 further includes a plurality of step-configured channels 214 sized to be removably installed upon an outer edge 216 of a gutter 218 (see FIG. 16) to further secure the position of the roof guard device 200.

Referring to FIG. 15, the guardplate 204 includes a plurality of longitudinal ribs 220 on both upper and lower surfaces 222 and 224 that are utilized for strengthening the guardplate 204 and to guide the rope used to lift an object from the ground to the roof. The guardplate 204 is capable of being removed by disassembling the hinge joint 206, and being reassembled such that the step-configured channels 214 now form part of an upper surface 226 of the stepplate 202 as illustrated in FIG. 17.

Figure 6:
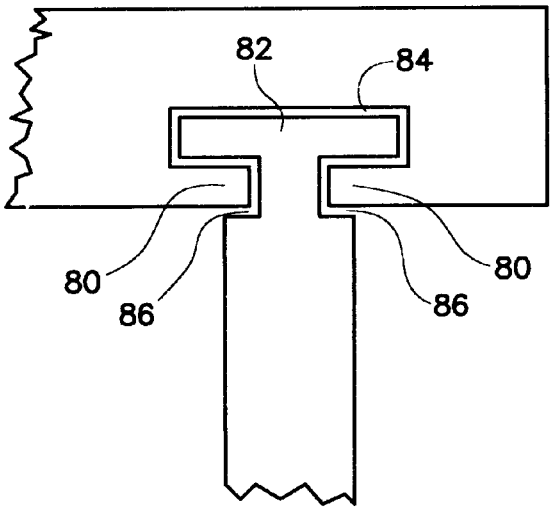
FIG. 6 is a cutaway side elevation view of a guardplate slidewedge inserted in a guardplate channel.
Figure 16:
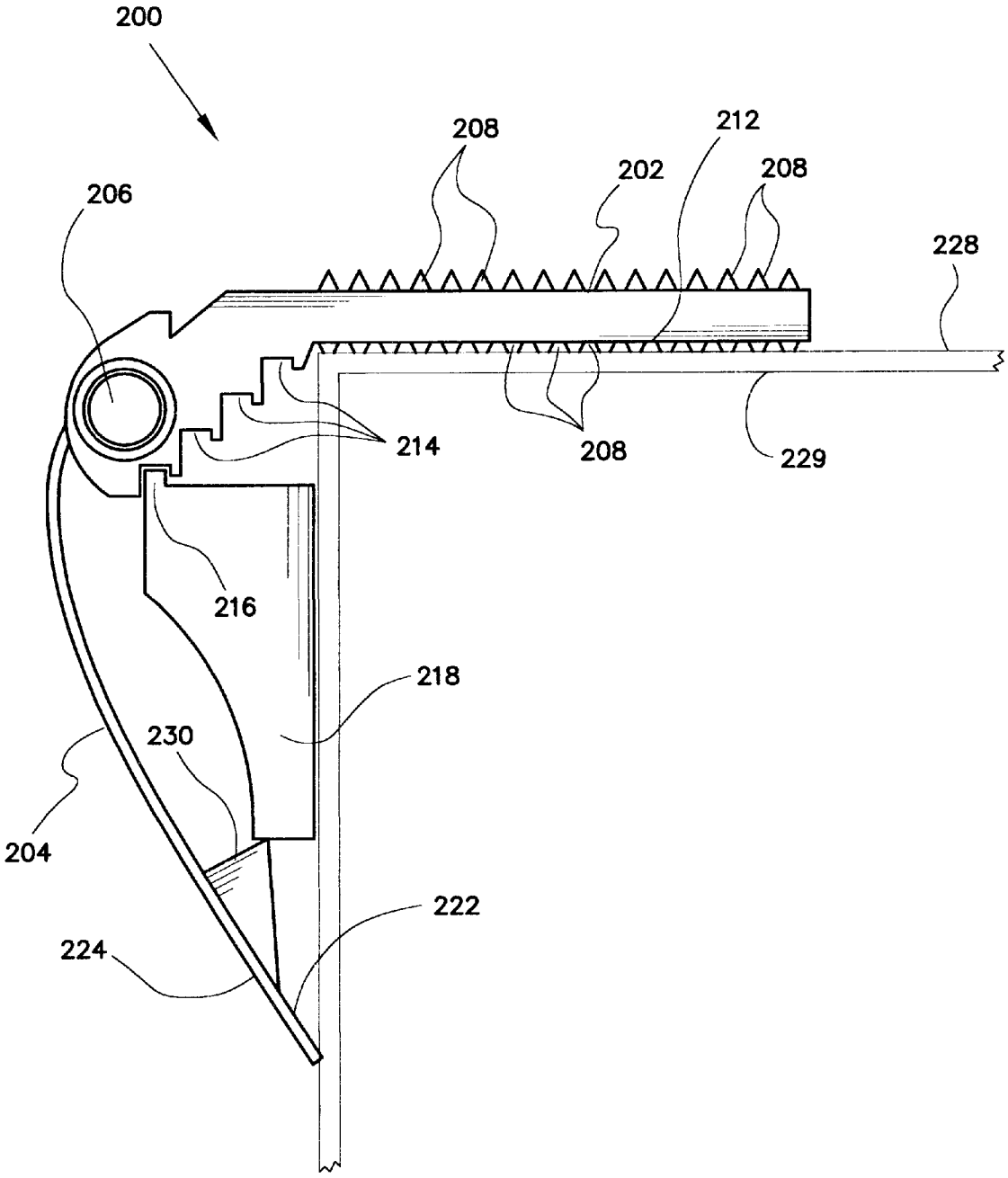
FIG. 16 is a side elevation view of the roof guard device of FIG. 15.

Referring to FIG. 16, a side elevation view of the alternative embodiment of the roof guard device 200 of FIG. 15 is shown. The device 200 is positioned upon a roof 228 of a building 229 such that one of the square configured channels 214, depending upon the gutter's dimensions, receives the outer edge 216 of the gutter 218. The diamond shaped spikes 208 of the lower surface 212 of the stepplate 202 are forced into the deformable tar portion of the roof 228 by a person standing on the stepplate. Slidewedges 230 are inserted into two guardplate slidewedge channels 232 (see FIG. 15) as illustrated in FIG. 6 to contact the gutter 218 and anchor the guardplate 204 to the gutter 218. The spikes 208, channels 216 and slidewedges 230 work in unison to securely attach the device 200 to the building 229 thereby enabling an individual to step off the device 200 without the device 200 falling to the ground.

Figure 17:
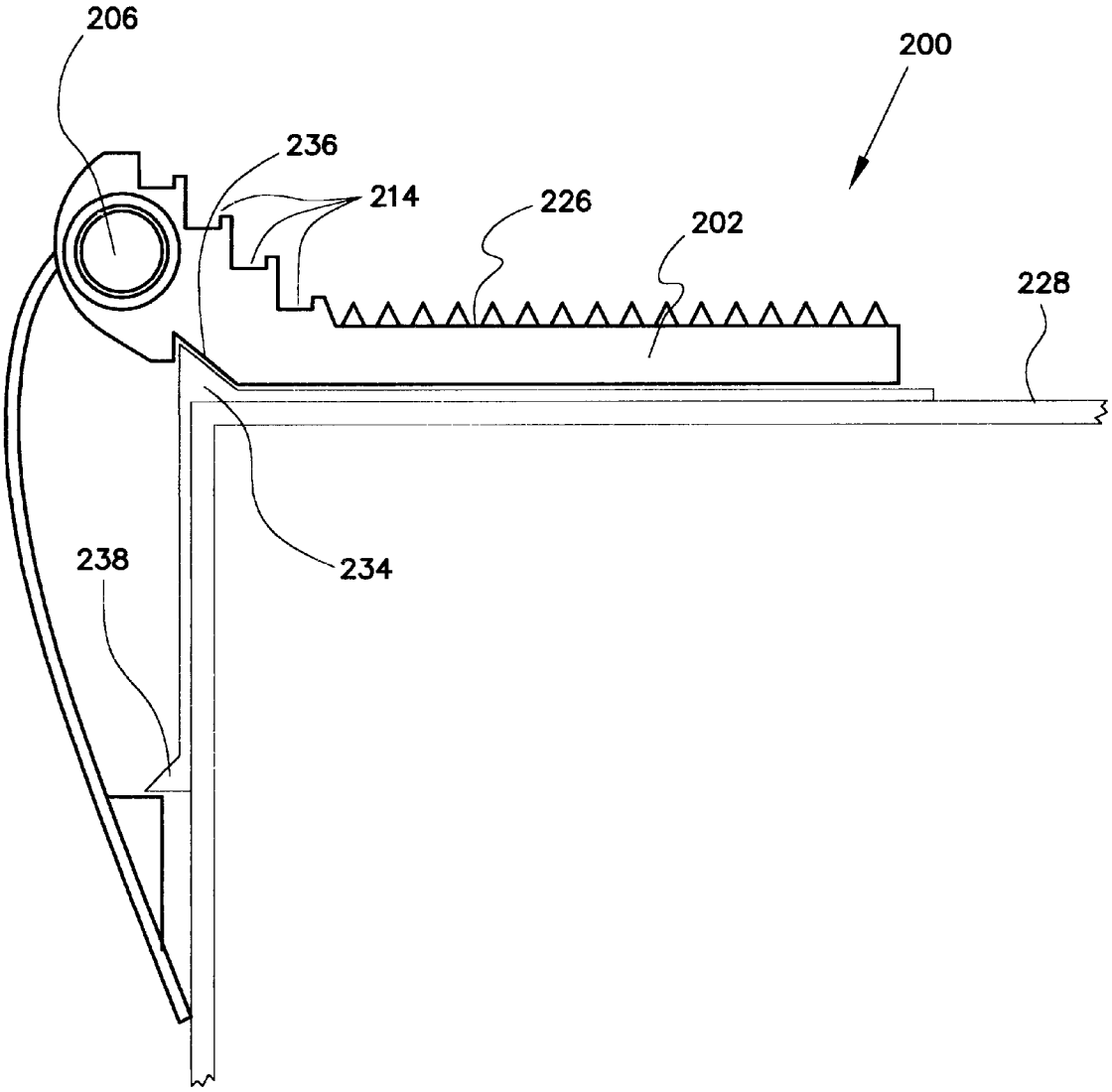
FIG. 17 is a side elevation view of the roof guard device of FIG. 15 with the stepplate having respective upper and lower surface positions reversed.

Referring to FIG. 17, a side elevation view of the alternative embodiment of the roof guard device 200 of FIG. 15 is shown with the upper surface 226 of the stepplate 202 having the square step-configured channels 214. Reversing the position of the stepplate 202 allows the stepplate 202 to be positioned upon a roof 228 having a gravel stop 234 around the perimeter of the roof 228 that prevents gravel and rock from being washed or blown off the building 229. The stepplate 202 is secured upon the roof 228 via a "V" channel 236 that removably receives the gravel stop 234. The V channel is more fully illustrated in FIG. 15. Two slidewedges are again inserted in slidewedge channels as described above to contact a lower extending portion 238 of the gravel stop 234 to anchor the guardplate 204 to the gravel stop 234. The spikes 208, V channel 236 and slidewedges 230 work in unison to securely attach the device 200 to the building 229 thereby enabling an individual to step off the device 200 without the device 200 falling to the ground.

Figure 18:
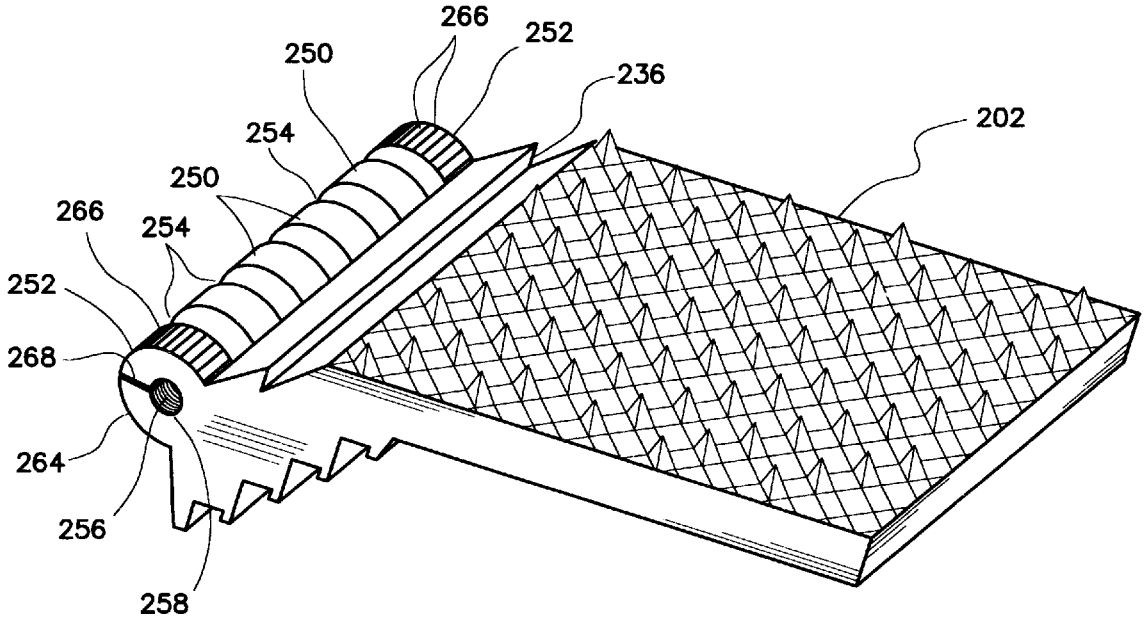
FIG. 18 is a perspective view of yet another alternative embodiment of a stepplate in accordance with the present invention.
Figure 19:
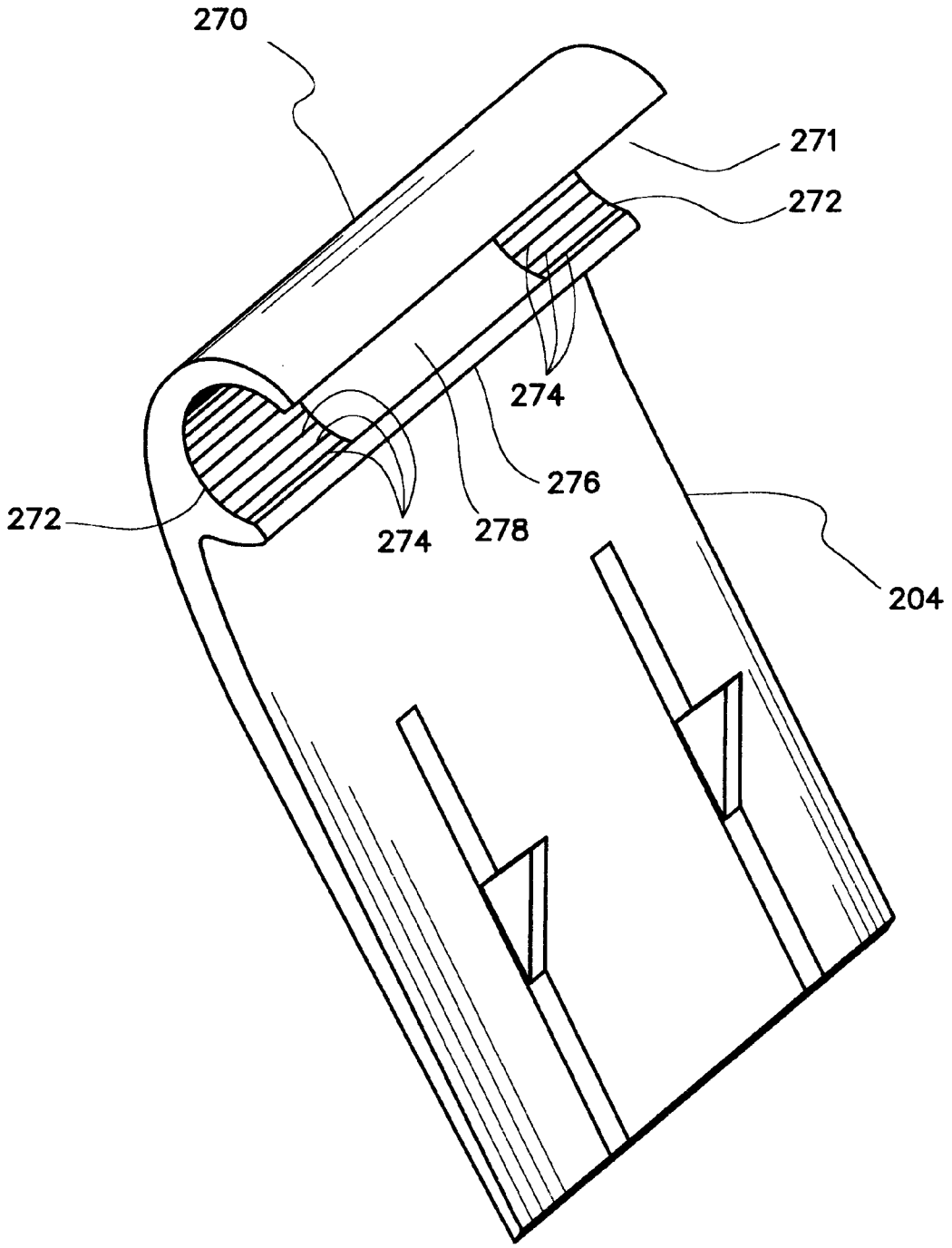
FIG. 19 is a perspective view of yet another alternative embodiment of a guardplate in accordance with the present invention.

Referring to FIGS. 18 and 19, perspective views of varied designs of the stepplate 202 and guardplate 204 of FIG. 15 are shown in accordance with the present invention. FIG. 18 depicts the stepplate 202 having multiple axially aligned, equal diameter, inner cylindrical sections 250 integrally joined to the V-channel 236. Also depicted are two outer cylindrical sections 252 axially aligned with the inner sections 250 and integrally joined to the V-channel 236. The outer sections 252 have substantially the same diameter as the inner sections 250.

Figure 20:
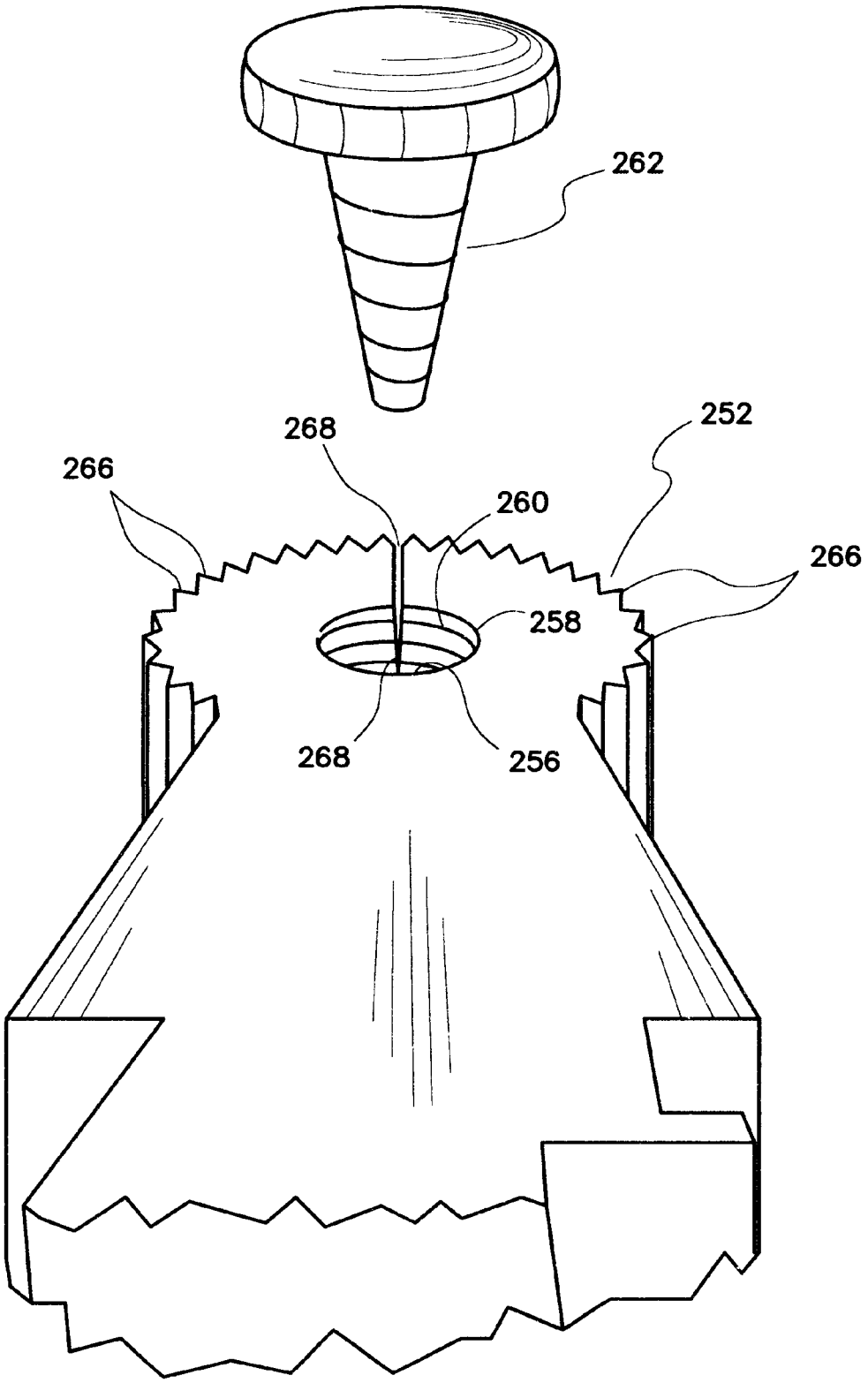
FIG. 20 is a perspective view of an expansion screw and the outer section of the stepplate depicted in FIG. 18.

The inner sections 250 are solid cylinders having an axial dimension relatively longer than "gap" 254 or distance between agent inner sections 250. The outer sections 252 include axially aligned orifices 256 extending longitudinally through the outer sections 252 with inner walls 258 having tapered threads 260 for receiving expander screw 262 (see FIG. 20). The outer sections 252 further includes an outer wall 264 having multiple "teeth" 266 or longitudinal projections parallel with the outer section axis. A channel 268 or expansion gap extends from the inner wall 258 of the orifice 256 to the outer wall 264 of the outer section 252; and longitudinally through the outer section 252.

The multiple inner section design 250 provides more flexibility to the stepplate 202 which avoids breakage when the stepplate is fabricated from plastic. The design of the two outer sections 252 allows the outer sections 252 to expand when tightening the expander screw 262 thereby securing the position of the guardplate 204 when attached to the stepplate 202.

Referring to FIG. 19, a modified guardplate 204 is depicted having an arcuate portion 270 forming a substantially cylindrical groove 271 when taking a side view of the guardplate 204 and extending laterally across the guardplate 204. The arcuate portion 270 includes two outer sections 272 having multiple interlocking teeth 274 extending parallel with the axis of the cylindrical groove 271. The interlocking teeth 274 are designed to mesh with the teeth 266 of the stepplate 202 when the expander screws are screwed into the two outer sections 252 of the stepplate 202. The arcuate portion 270 further includes an inner section 276 having a smooth cylindrically configured wall 278 to receive the multiple inner sections 250 of the stepplate 202.

In operation, the stepplate 202 and guardplate 204 are joined by inserting the outer and inner sections 252 and 250 of the stepplate 202 into the cylindrical groove 271 of the arcuate portion 270 of the guardplate 204. The stepplate 202 is positioned upon a selected edge portion of a roof. The guardplate 204 is then rotated to the desired position. The rotation is possible because the dimensioning of the meshed teeth 266 and 274 and expansion gap 268 is such that communicating portions separate just enough to allow rotation. Once the desired position of the guardplate 202 has been achieved, the expansion screws 262 are tightened into the threaded orifices 256 of both outer sections 252 until the guardplate 204 is securely locked in position.

Figure 21:
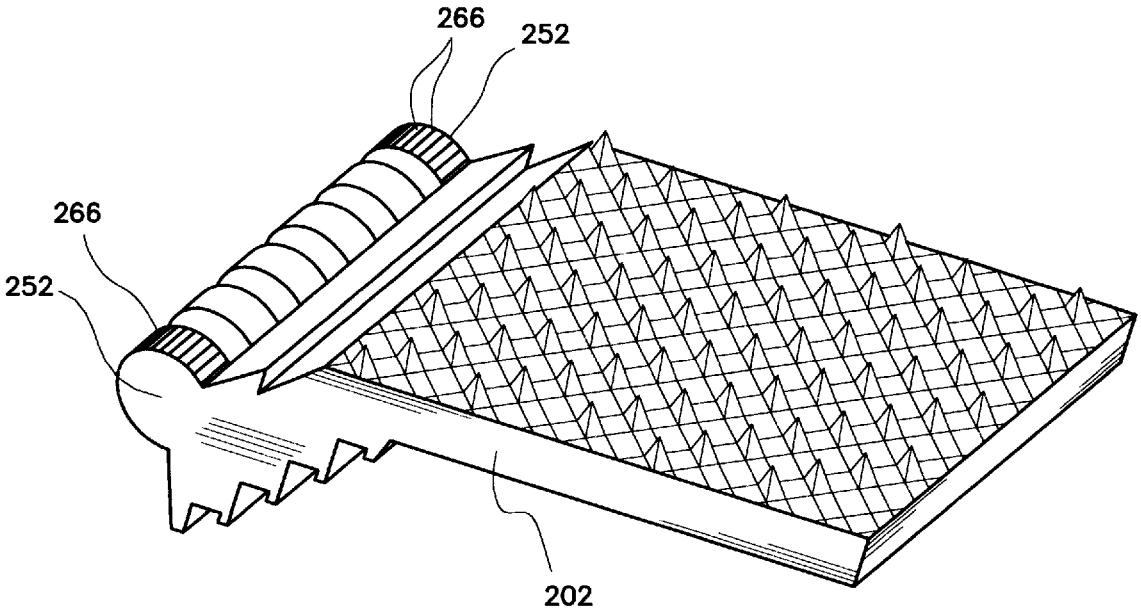
FIG. 21 is a perspective view of a modification of the stepplate depicted in FIG. 18 in accordance with the present invention.
Figure 22:
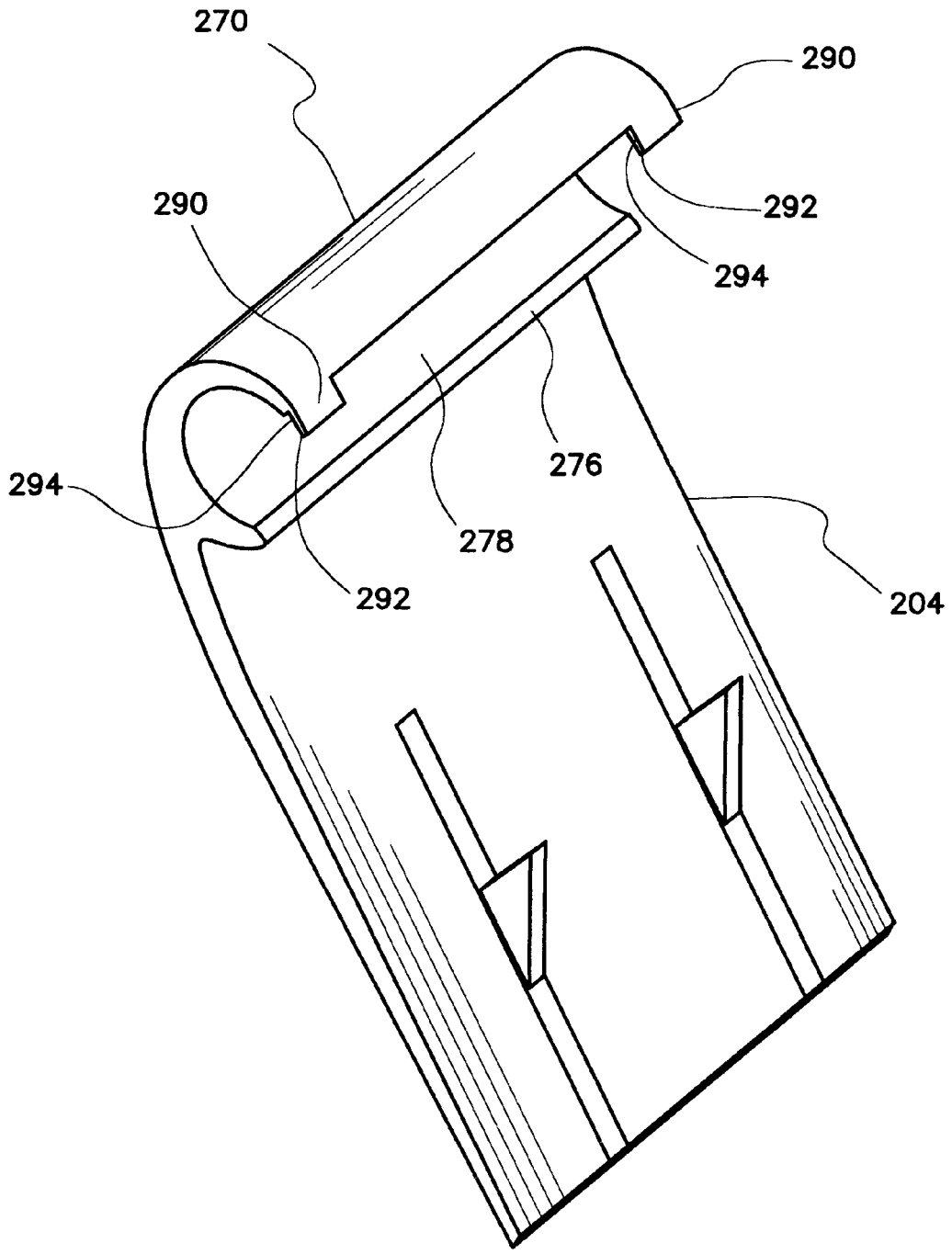
FIG. 22 is a perspective view of a modification of the guardplate depicted in FIG. 19 in accordance with the present invention.

Referring to FIGS. 21 and 22, modifications to the stepplate 202 and guardplate 204 shown in FIGS. 18 and 19 respectively, are depicted. FIG. 21 is a perspective view of the stepplate 202 of FIG. 18 with the outer sections 252 including the teeth 266, but without the orifice 256 and expansion gap 268. FIG. 22 is a perspective view of the guardplate 204 of FIG. 19 including the arcuate portion 270 but with the inner section 276 having only a smooth cylindrically configured wall 278. However, two ratchet portions 290 have been added at either end of arcuate portion 270.

The ratchet portions 290 are flexible extensions including a finger grip 292 and longitudinal lock tooth 294. The finger grip 292 allows one to lift the ratchet portions 290 thereby allowing rotation of the guardplate 204 to a desired position. After the finger grip 292 is released, the lock tooth 294 engages adjacent longitudinal teeth 266 of the outer sections 252 of the stepplate 202 thereby rigidly securing the guardplate 204 with respect to the stepplate 202.

The foregoing description is for purposes of illustration only and is not intended to limit the scope of protection accorded this invention. The scope of protection is to be measured by the following claims, which should be interpreted as broadly as the inventive contribution permits.

I claim:

1. A roof guard device for lifting objects onto a roof comprising:

a first member adapted to be removably received on a first portion of a roof structure;

a second member secured to said first member via joinder means, said joinder means enabling said second member to be variably positioned proximally to said first member, said second member adapted to positioned proximally to a second portion of the roof structure; and means for preventing communication between the second portion of the roof structure and an object urged against said second member of said device;

said second member further comprising:

means for securing said second member to the second portion of the roof structure;

means for providing rigidity to said second member; and means for maintaining the position of said second member.

2. The device of claim 1 wherein said first member includes an upper surface having a "V" configured channel to receive a gravel stop therein.

3. The device of claim 1 wherein said first member includes a lower surface having a step configured channel to receive an outer edge of a gutter therein.

4. A roof guard device for lifting objects onto a roof comprising;

a first member adapted to be removably received on a first portion of a roof structure;

a second member secured to said first member via joinder means, said joinder means enabling said second member to be variably positioned proximally to said first member, said second member adapted to positioned proximally to a second portion of the roof structure; and means for preventing communication between the second portion of the roof structure and an object urged against said second member of said device;

said communication prevention means further comprising:

an arcuately shaped second member having an edge portion positioned adjacent to a wall portion supporting the first and second portions of the roof structure; and means for locking in a pre-determined position for said second member.

5. A guard device for preventing communication between objects attached adjacent to a roof and items being lifted onto the roof comprising:

a first member adapted to be removably received on a perimeter portion of the roof;

a second member secured to said first member via joinder means, said joinder means enabling said second member to be variably positioned proximally to said first member and the objects attached adjacent to the roof, said second member being arcuately shaped and having an edge portion positioned adjacent to a wall portion supporting the roof; and means for locking-in a pre-determined position for said second member.

* * * * *